US007278898B2

(12) United States Patent
Kim et al.

(10) Patent No.: US 7,278,898 B2
(45) Date of Patent: Oct. 9, 2007

(54) FENCING TRAINING SWORD

(76) Inventors: Jeong-Seung Kim, 129-201, Dongh Sollecity, 1162 Bojung-ri, Guseong-eup, Yongin-si, Gyeonggi-do (KR); Jeong-Ho Kim, 129-201, Dongh Sollecity, 1162 Bojung-ri, Guseong-eup, Yongin-si, Gyeonggi-do (KR)

( * ) Notice: Subject to any disclaimer, the term of this patent is extended or adjusted under 35 U.S.C. 154(b) by 9 days.

(21) Appl. No.: 10/562,484

(22) PCT Filed: Jul. 5, 2004

(86) PCT No.: PCT/KR2004/001650

§ 371 (c)(1),
(2), (4) Date: Dec. 27, 2005

(87) PCT Pub. No.: WO2005/002685

PCT Pub. Date: Jan. 13, 2005

(65) Prior Publication Data

US 2006/0141432 A1 Jun. 29, 2006

(30) Foreign Application Priority Data

Jul. 4, 2003 (KR) ..... 10-2003-0045429
Dec. 4, 2003 (KR) ..... 10-2003-0087650
Jun. 11, 2004 (KR) ..... 20-2004-0016393 U

(51) Int. Cl.
*A63H 33/30* (2006.01)
*A63H 33/00* (2006.01)

(52) U.S. Cl. ..... 446/473; 463/47.2; 434/11; 482/12

(58) Field of Classification Search ..... 446/473
See application file for complete search history.

(56) References Cited

U.S. PATENT DOCUMENTS 4,819,137 A * 4/1989 Hamilton ..... 362/102

(Continued)

FOREIGN PATENT DOCUMENTS

JP 7-88214 4/1995

(Continued)

OTHER PUBLICATIONS

International Search Report dated Oct. 30, 2004 for PCT/KR2004/001650.

*Primary Examiner*—Kien T Nguyen
(74) *Attorney, Agent, or Firm*—Lowe Hauptman Ham & Berner LLP

(57) ABSTRACT

The present invention relates to a sword for a trainee in the art of swordsmanship; and more particularly, to a multistructured sword of a double or triple structure having a shock-absorbing space in a sword body. Accordingly, the trainee can effectively practices stabbing and cutting actions in the traditional swordsmanship by reducing a shock imposed on him. The present invention includes: a grip formed at an end of the training sword; a sword body member, wherein the sword body member includes at least one sword body inner cover for reducing a shock generated by a striking action and a sword body outer cover, which covers the sword body inner cover, wherein a gap is provided between the sword body inner cover and the sword body outer cover; a cross-guard formed at a boundary between the sword body member and the grip; and a scabbard for protecting the sword body member, wherein a length of the scabbard is shorter than that of the sword body member so that the sword body member passes through the scabbard.

27 Claims, 8 Drawing Sheets

U.S. PATENT DOCUMENTS

| | | | | |
|---|---|---|---|---|
| 5,324,227 | A * | 6/1994 | Yuh-Ching | 446/473 |
| 6,036,602 | A * | 3/2000 | Abbott | 463/47.2 |
| 6,352,465 | B1 * | 3/2002 | Heymann et al. | 446/473 |
| 6,497,619 | B2 * | 12/2002 | Dowdy et al. | 463/47.2 |

FOREIGN PATENT DOCUMENTS

| | | |
|---|---|---|
| JP | 2001-178858 | 7/2001 |
| KR | 2003-0028870 | 4/2003 |

* cited by examiner

FENCING TRAINING SWORD

CROSS REFERENCE TO RELATED APPLICATION

This application is the National Phase application of International Application No. PCT/KR2004/001650, filed Jul. 5, 2004, which designates the United States and was published in English. This application, in its entirety, is incorporated herein by reference.

FIELD OF THE INVENTION

The present invention relates to a sword for a trainee in the art of swordsmanship; and more particularly, to a multistructured sword of a double or triple structure having a shock-absorbing space in a sword body in order that a shock of the sword is absorbed in a sword body in a degree to which a trainee effectively practices exercising the swordsmanship and learns basic postures in the sword fighting practice.

BACKGROUND OF THE INVENTION

A training sword for acquiring great skill has been used in the art of swordsmanship, such as a sword fighting or basic postures. In particular, a trainee can exercise basic practices, such as cutting and stabbing techniques, with the training sword as if he handles a real sword. Also, this training sword can prevent the trainee from inflicting a wound upon another trainee in the sword fight. A training sword according to the present invention can absorb a shock of the sword in the sword fighting practice and be compatible with a plurality of scabbards, each of which has a different type in length.

In general, the swordsmanship, as a martial art for cultivating body and soul, is a kind of sport in which the trainees strike an opponent's head, wrist or waist with the training sword, or stabs the opponent's body. The swordsmanship is a popular sport for cultivating personality and also for self-defense.

In a training sword for the basic actions or posture exercises, the swordsmanship techniques or the sword fighting practice with a counterpart, a wooden or bamboo sword has been used or an imitative sword, which is similar to a real sword made of iron, has been also used without a blade.

However, in case of the bamboo sword, it is not suitable for the swordsmanship practice because the shape is not good for the stabbing or cutting action which is essential in the art of swordsmanship. Namely, in case where the bamboo sword is used in a traditional swordsmanship, the basic actions such as cutting and stabbing actions cannot be practiced effectively because of many problems such as trainee's unnatural motion. Further, in case of the sword fighting practice with an opponent, the above problems grow heavier and the fighting practice itself cannot be possible. Also, to solve the problems in the bamboo sword, the wooden sword has been widely used in the art of the swordsmanship; however, it can give a great shock on an opponent trainee and it can be easily broken by such a great shock.

As shown in FIG. 1, an imitative sword, which is similar to a real sword, includes a sword body 101, a grip 102, a cross-guard 104 and a scabbards 103 and, in case of using this imitative sword, a nonskilled level trainee can be wounded through his carelessness so that general trainees, except for a specialist, cannot use such the imitative sword.

On the other hand, the sword body of the above-mentioned imitative sword is made of solid body, for example, injection molded synthetic resin, or an aluminum body which undergoes quenching and polishing processes. In case of the synthetic resin sword for practice, a weight is inserted into the body of the sword in order that the trainee can feel reality of a real sword by making the weight of the synthetic resin sword and the real sword the same. Accordingly, the trainee can effectively practice the basic actions or postures of the traditional swordsmanship without a specific problem; however, it can impose a burden on his wrist joint or arm muscles due to the long-time exercise with the weight-inserted sword. In the sword fighting practice with an opponent trainee, the weight-inserted sword can inflict a wound on the trainee because the sword itself is a solid body. Accordingly, the weight-inserted sword is not suitable for the imitative sword in the sword fighting practice.

Also, the training swords such as wooden swords are classified and manufactured by the trainee's height and these swords are sold with scabbards having portable and protecting devices. However, these swords are different from each other in length due to the manufacturer's processes. Since these scabbards are designed to block the end of the blade, there is no compatibility with other swords so that the scabbard should be designed based on a specific sword. Further, in case where the scabbard is lost, it is difficult to obtain another scabbard to fit in the sword.

DETAILED DESCRIPTION OF THE INVENTION

Summary of the Invention

To solve the above problem, an object of the present invention is to provide a new training sword, which reduces a shock on a trainee or an opponent in the sword fighting practice and helps the trainee effectively exercise the basic postures and actions for stabbing and cutting practices in the traditional swordsmanship, by providing a space within the sword body and by forming the sword body of double or triple structure for shock-absorbing layers.

Another object of the present invention is to provide a new training sword to reduce a shock on a trainee by forming a movable part in a sword body and then by making a sword body contracted in the direction of its axis.

Further, another object of the present invention is to provide a new training sword which is compatible with different scabbards. Therefore, the new training sword according to the present invention well fits in long and short scabbards for both children and adults with the improvement of the portable swords.

[Technical Solution]

To achieve the object mentioned above, a training sword for absorbing a shock according to the present invention comprises: a grip for handling the training sword, being formed at an end of the training sword; a sword body member, wherein the sword body member includes at least one sword body inner cover for reducing a shock generated by a striking action and a sword body outer cover which covers the sword body inner cover, wherein a gap is provided between the sword body inner cover and the sword body outer cover; and a scabbard for protecting the sword body member, wherein a length of the scabbard is shorter than that of the sword body member so that the sword body member passes through the scabbard.

[Useful Effectiveness]

According to the present invention, when a trainee brings into the sword fighting practice and a shock is imposed on the body of an opponent trainee by the cutting, striking or stabbing action, a shock is mitigated by an air shock-absorbing layer formed in the double-structured sword body and a shock-absorbing spring mitigates a shock at the time of taking an stabbing action. By this structure, when a trainee brings into the sword fighting practice, there is no crack or breakdown which are generated in the conventional bamboo and wooden swords. Therefore, there is nothing to worry about an injury on the opponent's body, it is possible to sharply reduce an impact by a strike or hit, and then a burden on the sword fighting practice can be remarkably reduced.

Also, this double-structured sword can increase satisfaction through striking sound effects in the sword fighting practice because sounds bumped in the practice are big and light.

Also, because the sword body has a hollow structure in which a space is provided in the inner part of the sword body, the weight of the sword is light and the shock from striking can be naturally absorbed through the structure of the new sword. Accordingly, this double-structured sword does not impose a burden on his wrist joint or arm muscles although the trainee exercises for a long time and the basic practice, such stabbing and cutting actions, are effectively and exactly achieved.

Also, in the present invention, by forming the sword body and grip into an injection molded synthetic resin, the sword takes various kinds of colors according to user's taste. Also, there is another effect that the sword can be formalized with the feeling of the real sword and the straight or curvature of the sword can be designed upon request from the trainee. Besides, because the sword according to the present invention is an injection molded synthetic resin, being different from the wooden sword, the synthetic resin sword is not influenced to surroundings of moisture so that it can be hygienically and semipermanently used by preventing the deformation, such as a wrench, which is caused by the contraction and corrosion of the sword.

BEST EMBODIMENT OF THE INVENTION

Figure 1:
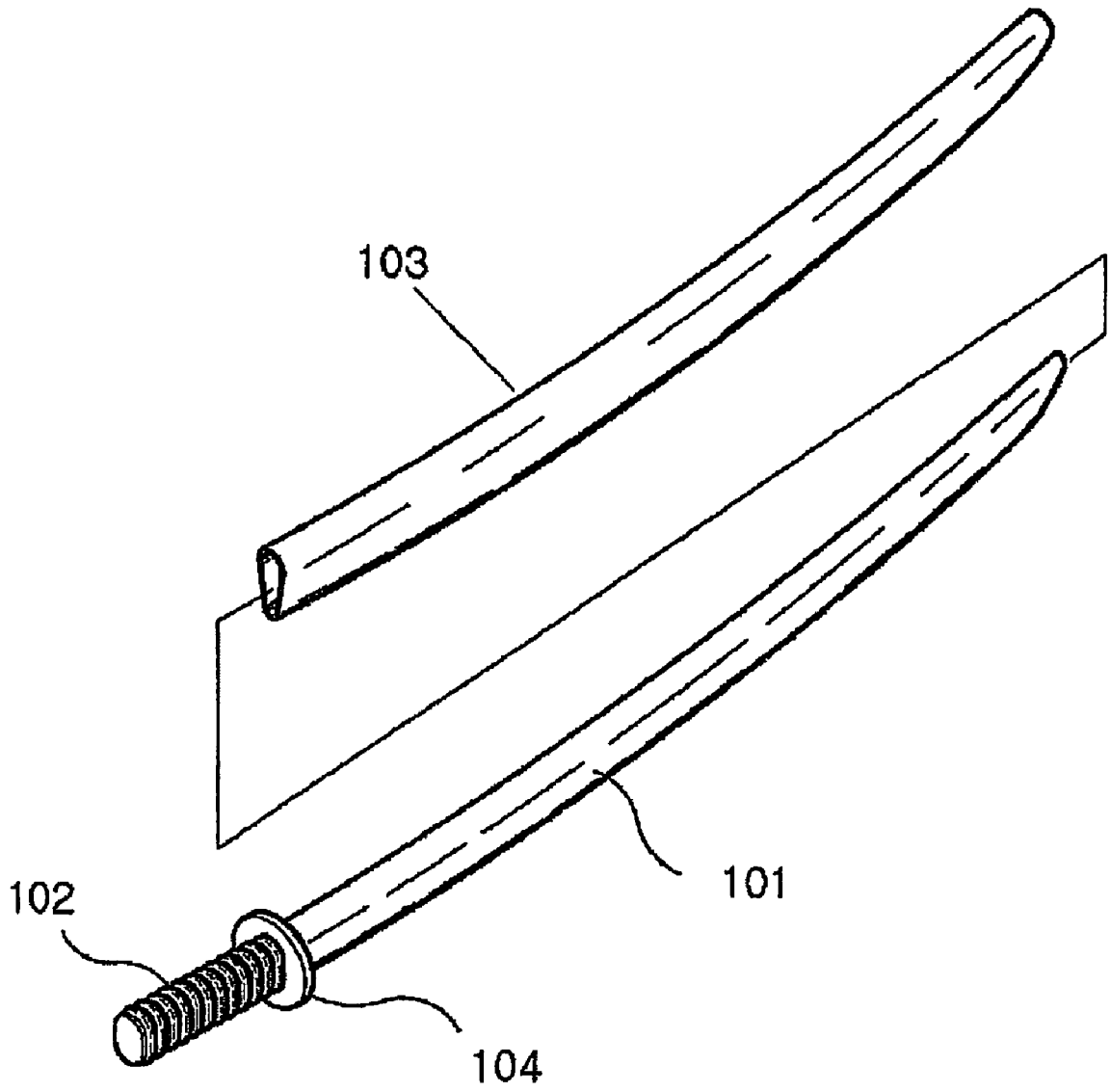
FIG. 1 is a perspective illustrating a conventional training sword.
Figure 2:
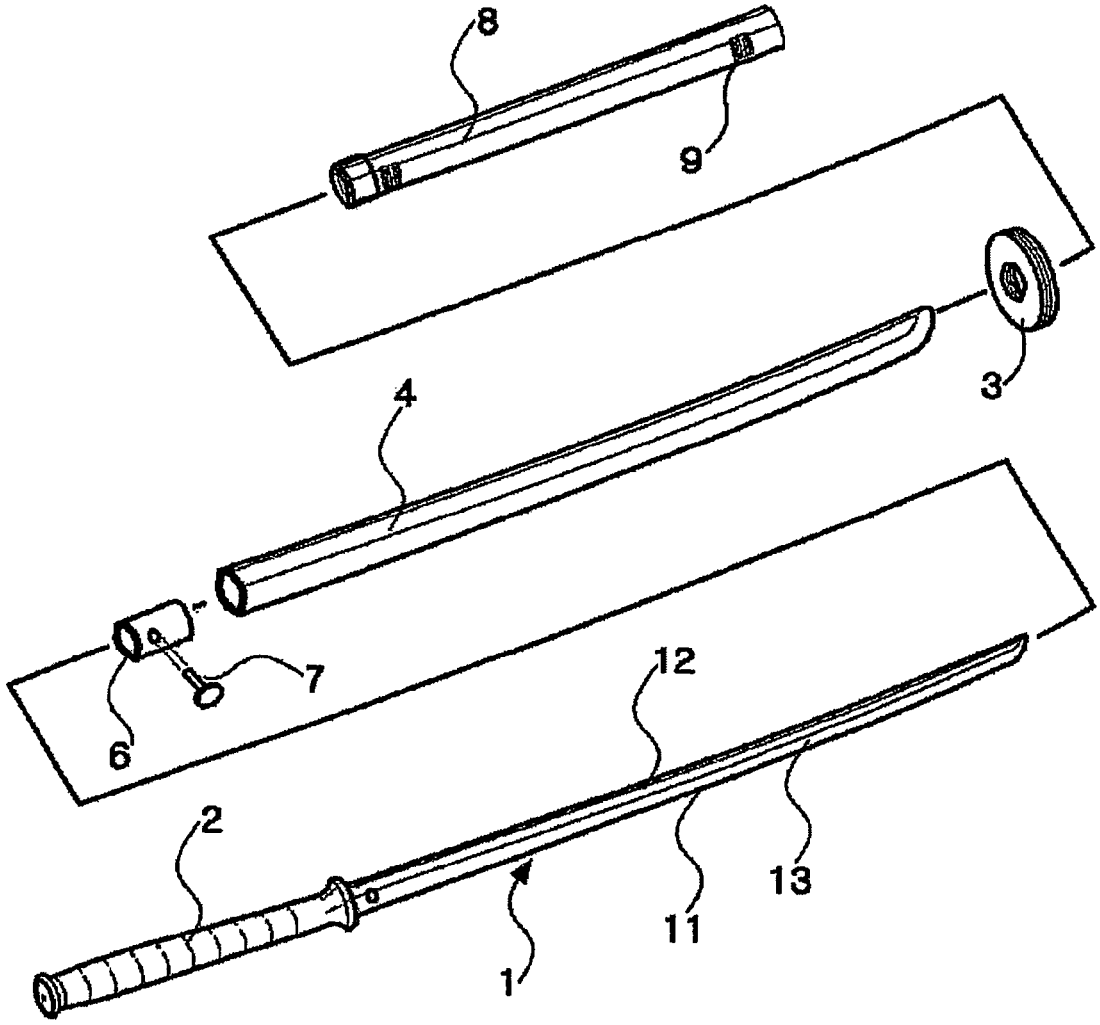
FIG. 2 is a perspective illustrating an assembly of a training sword according to a first embodiment of the present invention.

In accordance with an aspect of the present invention, there is provided a training sword for absorbing a shock comprising: a grip for handling the training sword, being formed at an end of the training sword; a sword body member, wherein the sword body member includes at least one sword body inner cover for reducing a shock generated by a striking action and a sword body outer cover which covers the sword body inner cover, wherein a gap is provided between the sword body inner cover and the sword body outer cover; and a scabbard for protecting the sword body member, wherein a length of the scabbard is shorter than that of the sword body member so that the sword body member passes through the scabbard.

The sword body member, in a multistructure, includes a first sword body inner cover and the grip and the first sword body inner cover are formed in a body.

A shock-absorbing rubber member is inserted between the first sword body inner cover and the sword body outer cover for providing the predetermined gap. A shock from the sword body outer cover is not directly transferred to the grip due to the shock-absorbing rubber member.

A scabbard according to the present invention is applicable to different types of sword bodies, irrespective of the length of the sword body. Rings are respectively formed at both ends of the scabbard and strings are tied to the rings for the trainee to carry the scabbard with the sword body. The trainee can hold the training sword on his waist or on his back in the diagonal direction.

In accordance with another aspect of the present invention, there is provided a training sword in accordance with claim 6, wherein the shock-absorbing and restoring member includes: a first supporting plate formed at a neck of the first sword body inner cover and radically extended; a second supporting plate formed at an end of the sword body outer cover and radically extended, being opposite to the first supporting plate; a plurality of fixed protrusions respectively formed at the first and second supporting plates; a plurality of shock-absorbing springs fixed to both ends of the fixed protrusions; and a cover case, one end of which is fixed to an outer circumference of the first supporting plate and the other end of which is fixed to an outer circumference of the second supporting plate. The sword body outer cover is shrunk from its original position to the grip by a predetermined distance and gets back to the original position.

In accordance with further another aspect of the present invention, there is provided a training sword comprising: a sword body having a blade part, a sword back part, a side part and an incised recess, wherein the incised recess is formed by removing a predetermined position of the sword body; a plurality of supporting means formed in the incised recess, along the blade part; a first shock-absorbing means formed at the front end of the sword body, being in contact with an object when a stabbing action is taken; a second shock-absorbing means joined to the supporting means formed in the incised recess for reducing a shock, being in contact with the object when a cutting action is taken; a grip formed at an end of the training sword.

Hereinafter, the present invention will be described in detail referring to the accompanying drawings of FIGS. 2 to 13.

A training sword according to the present invention has a multistructure which is capable of absorbing a shock of the sword in the sword fighting practice at the time of exercising the sword fighting practice and basic postures. A first embodiment will be described in detail referring to FIGS. 2 to 5.

According to the first embodiment of the present invention, the training sword includes a space 1*a* in the inner part thereof and a blade part 11 is formed in a lower part of the training sword in the longitudinal direction of the body. A blade part 11 includes a back of the sword (hereinafter, referred to as a sword back part 12) formed at an upper part thereof and a side part 13 formed at the side of a sword body inner cover 1 in the longitudinal direction of the sword body. A grip 2 for handling the training sword is formed, covering a space 2*a* which is continuously formed with the space 1*a* in the sword body inner cover 1. A cross-guard 104 is formed at the boundary between the sword body inner cover 1 and the grip 2 in order to protect the trainee's hands from another training sword of his opponent during the sword fighting practice. A sword body outer cover 4 has the same shape as the sword body inner cover 1 and covers the sword body inner cover 1 and a gap (t) for providing a shock-absorbing air layer 5 which is formed between the sword body outer cover 4 and the sword body inner cover 1. A rubber band 6 is inserted into a neck portion of the sword body inner cover 1 and is fixed thereto. This rubber band 6 to provide friction prevents the sword body inner cover 1 from getting removed from the sword body outer cover 4. A scabbard 8 protects the fixing member 7 which passes through the rubber band 6 and sword body inner cover 1 and also protects the sword body outer cover 4 in order that the trainee easily carries his sword.

In the present invention, the sword body inner cover 1 and the grip 2 are formed in a body and the sword body inner and outer covers 1 and 4 have endurance to stand a shock in the sword fighting practice and have ductility of the synthetic resin.

When the trainee brandishes the training sword to an opponent trainee or an object, the sword body outer cover 4 comes into collision with the sword body inner cover 1 and the shock-absorbing air layer 5 provided in the sword body absorbs a shock from the training sword. Although the shock is absorbed by the shock-absorbing air layer 5, the sound effect is more increased by the collision of the sword body inner and outer covers 1 and 4. Preferably, the gap forming the shock-absorbing air layer 5 between the sword body inner and outer covers 1 and 4 is approximately in a range of 2-5 mm. In case that the gap is over 5 mm, the sword body outer cover 4 is not fixed, but rocked so that the trainee cannot make a natural action in the swordsmanship. Also, in case that the gap is below 2 mm, the effects on the shock-absorbing air layer 5 and the shock sound may be reduced and it is difficult to join the sword body inner and outer covers 1 and 4 together.

Figure 3:
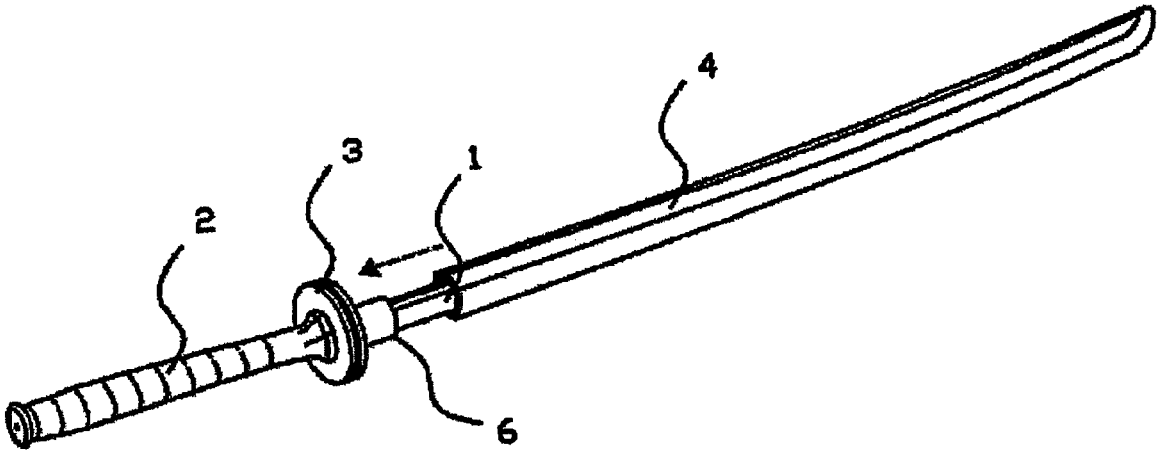
FIG. 3 is a perspective illustrating an assembly of a sword body in FIG. 2.
Figure 4:
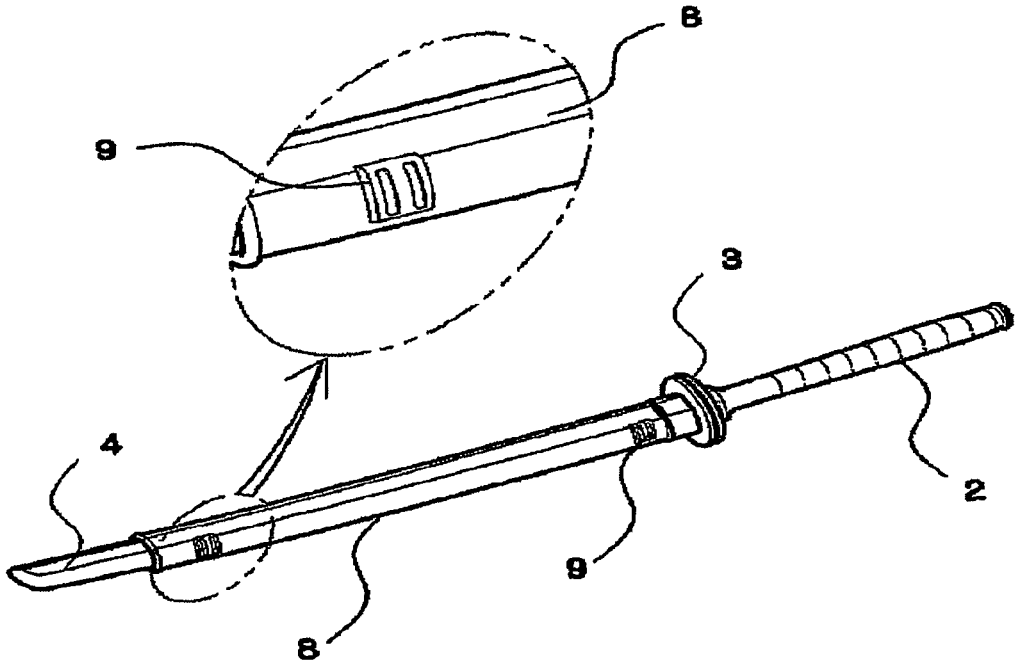
FIG. 4 is a perspective illustrating a scabbard and an insertion of the sword body in FIG. 2.
Figure 5:
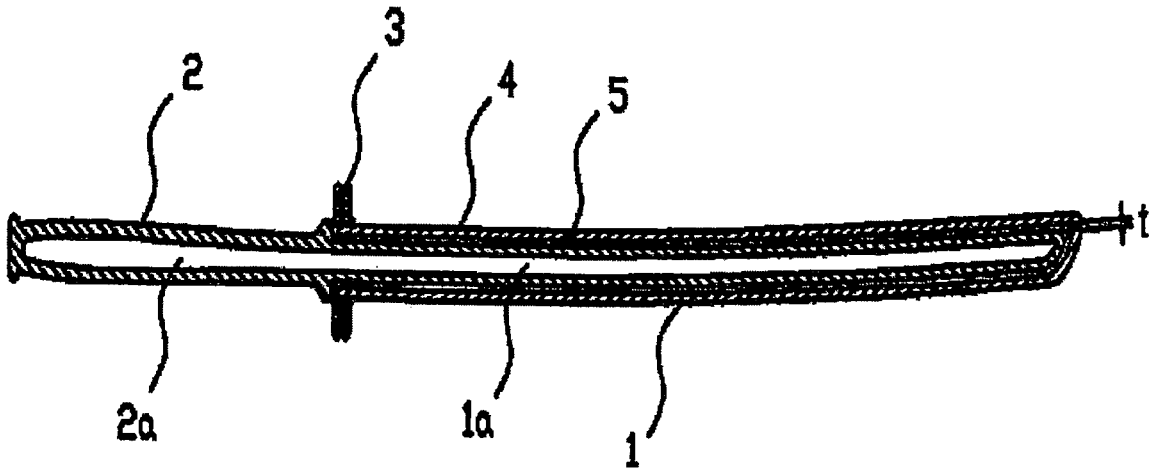
FIG. 5 is a cross-sectional view illustrating the sword body in FIG. 3.

In the above-mentioned present invention, as shown in FIG. 3, when the sword body inner cover 1 is inserted into the sword body outer cover 4 along the arrow, the rubber band 6 is tightly inserted into the sword body outer cover 4 by the friction between the rubber band 6 and the sword body outer cover 4 so that the sword body outer cover 4 is not removed from the sword body inner cover 1 even if the trainee take actions of brandish and striking in the sword fighting practice.

In the first embodiment of the present invention, the sword body has a double structure of the sword body inner and outer covers 1 and 4; however, the present invention is not restricted to this double structure. It is possible to make the sword body inner cover 1 itself have a triple or more multiple structure. The shapes of the sword body inner and outer covers 1 and 4 can be modified.

For example, in case of the double structure having first and second sword body inner covers, a first gap between the first sword body inner cover and the sword body outer cover 4 is formed in a range of 2~5 mm and a gap between the first sword body inner cover and the second body inner cover is formed less than the first gap, preferably, in a range of 1~4 mm. The grip 2 can be formed with the second body inner cover in a body.

When the sword body inner cover has the double structure, that is, in case where another sword body inner cover is further inserted into the sword body inner cover, a rubber band, as a joint and shock-absorbing member 6, is inserted between the two sword body inner covers in order to prevent these sword body inner covers from being removed from each other. To improve the joint between these sword body inner covers, the fixing member 7 passing through the rubber band and the sword body inner covers is used.

In the scabbard 8, which is also made from the injection molded synthetic resin and has a shape in which the sword body outer cover 4 is easily inserted into the scabbard 8, the sword is easily drawn from the scabbard 8, and fits in the scabbard 8. Preferably, the scabbard 8 well fits in short and long sword bodies for both children and adults, that is, the scabbard 8 can be compatible with different sword bodies. In the preferable embodiment of the present invention, the scabbard 8 is shorter than the sword body and then the end of the scabbard 8 is penetrated by the sword body outer cover 4. Accordingly, the scabbard 8 can be used for both children and adults, irrespective of the length of the sword body. The modification of shape of the training sword is also possible and is well known to those skilled in the art to which the subject pertains.

Particularly, rings 9 are respectively formed at both ends of the scabbard 8 and strings are tied to the rings 9 for the trainee to carry the scabbard 8 with the sword body. The trainee can hold the training sword on his waist or on his back in the diagonal direction.

As a result, in the present invention, since the scabbard required to take the sword securing action or the sword drawing action can be designed irrespective of the length of the sword body, the fabrication of the scabbard is simple and it is convenient for use.

Figure 6:
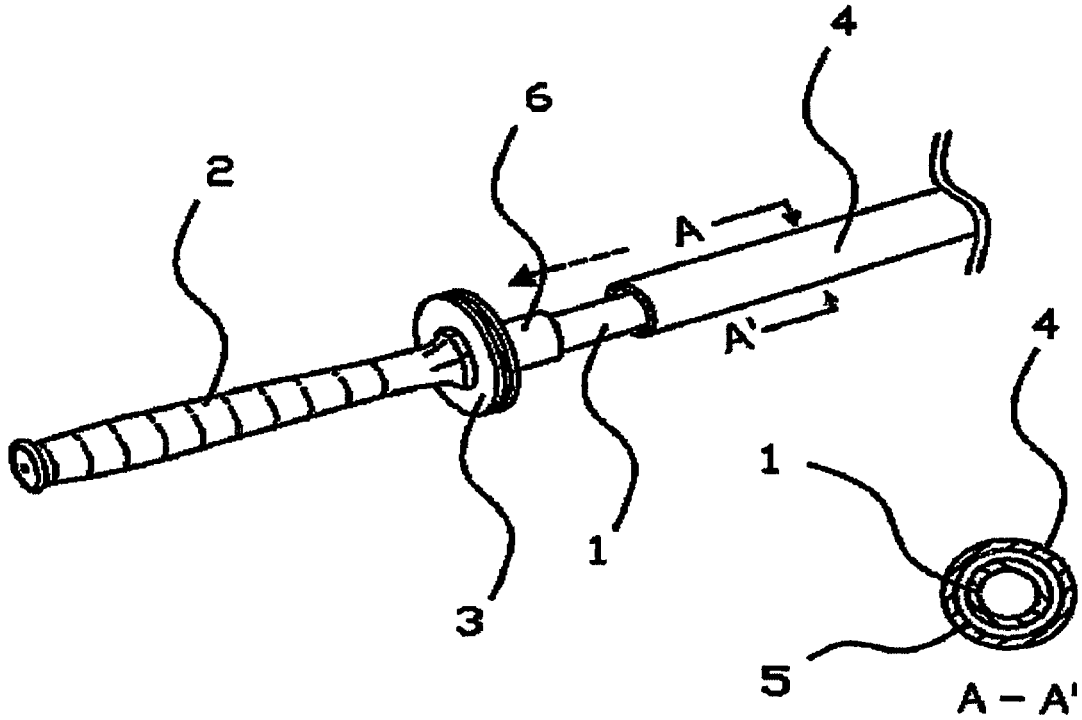
FIG. 6 is a partial perspective illustrating a rod-type body of the training sword according to the present invention.

The above-mentioned embodiment of the present invention is showing the sword body inner or outer covers 1 and 4, the blade part 11, the sword back part 12 and the side part 13, while FIG. 6 is showing a cross-sectional view of another embodiment of the present invention in which the sword body inner or outer covers 1 and 4 are modified to have a shape of rod of which cross-sectional view is circular.

Since the training sword is made from the injection molded synthetic resin, it is possible to take various kinds of colors according to the user's taste and to make different swords based on the figures of the trainees who may be adults, men, women, or children.

A second embodiment of the present invention will be described in detail referring to FIGS. 7 to 9.

In the second embodiment, when the trainee stabs at his opponent in the sword fighting practice, the sword body outer cover 4 shrinks back from its original position toward the grip 2 in order to reduce a shock on his opponent. The sword body inner cover 1 is formed to be shorter than the sword body outer cover 4 by a predetermined length. This length is determined by a shrinking distance of the sword body outer cover 4. A shock-absorbing and restoring member is formed between the grip 2 and an end of the sword body outer cover 4.

Figure 7:
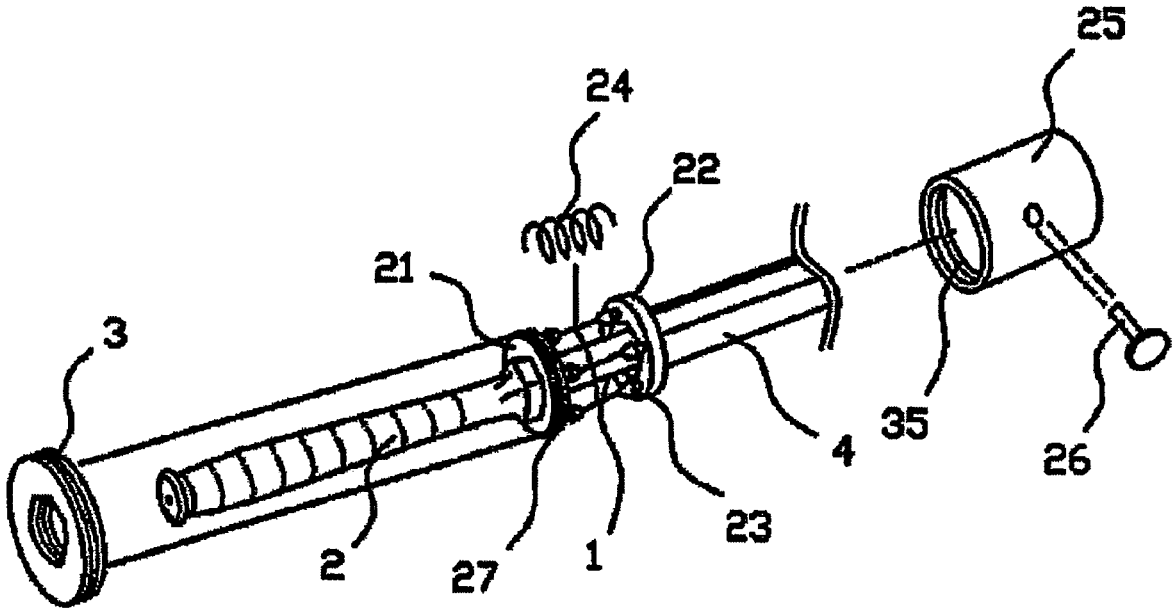
FIG. 7 is a perspective illustrating an assembly of a training sword according to a second embodiment of the present invention.
Figure 8:
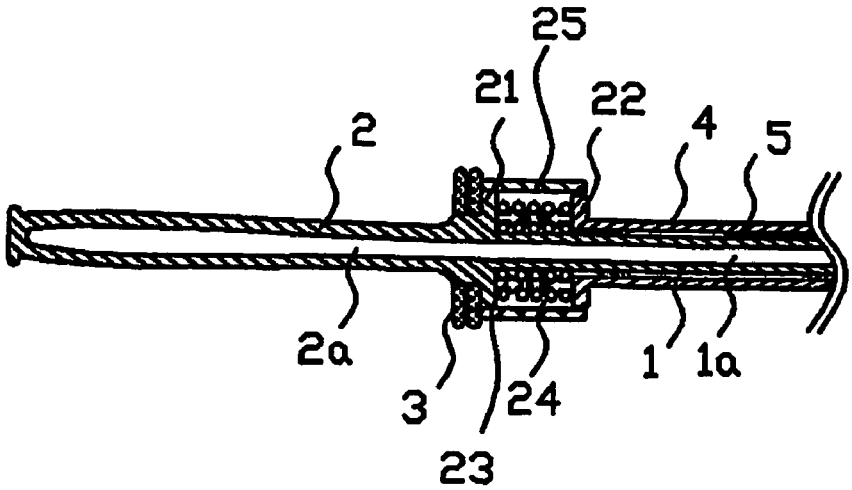
FIG. 8 is a cross-sectional view illustrating a partial assembly of a sword body in FIG. 7.

Referring to FIGS. 7 and 8, the training sword includes: a first supporting plate 21, which is in a type of disk, formed at a neck of the sword body inner cover 1; a second supporting plate 21, which spaces out from the first supporting plate 21 and is in a type of disk, formed at a neck of the sword body outer cover 4 which is opposite to the neck of the sword body inner cover 1; a plurality of fixed protrusions 23 respectively formed at the first and second supporting plates 21 and 22 in the direction of the axis of the sword body wherein the plurality of fixed protrusions 23 formed at the first supporting plate 21 are opposite to the plurality of fixed protrusions 23 formed at the second supporting plate 22; a plurality of shock-absorbing springs 24 fixed to both ends of the fixed protrusions 23 on the first and second supporting plates 21 and 22; a cylindrical cover case 25, one end of which is fixed to an outer circumference of the first supporting plate 21 and the other end of which is fixed to an outer circumference of the second supporting plate 22, covering the plurality of shock-absorbing springs 24; and a fixing member 26 passing through and fixing the cylindrical cover case 25 and the sword body inner cover 1.

In the above-mentioned structure, since the shock-absorbing springs 24 are individually formed on the fixed protrusions 23, the shock-absorbing springs 24 shrink from their original positions and the sword body outer cover 4 is pushed toward the grip with the further covering of the sword body inner cover 1 when the trainee stabs the sword into an opponent or an object. As a result, a shock on the opponent is absorbed somewhat. When the stabbing action has been finished, the sword body outer cover 4 is restored by elasticity of the shock-absorbing springs 24.

Figure 9:
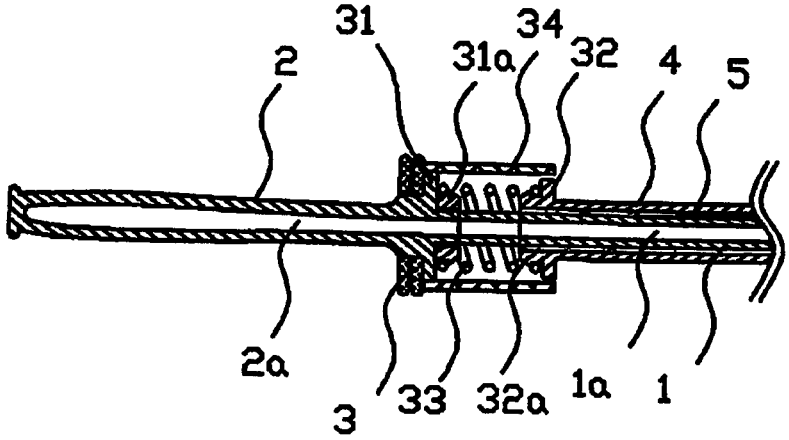
FIG. 9 is a cross-sectional view illustrating modification of the sword body in FIG. 8.
Figure 10:
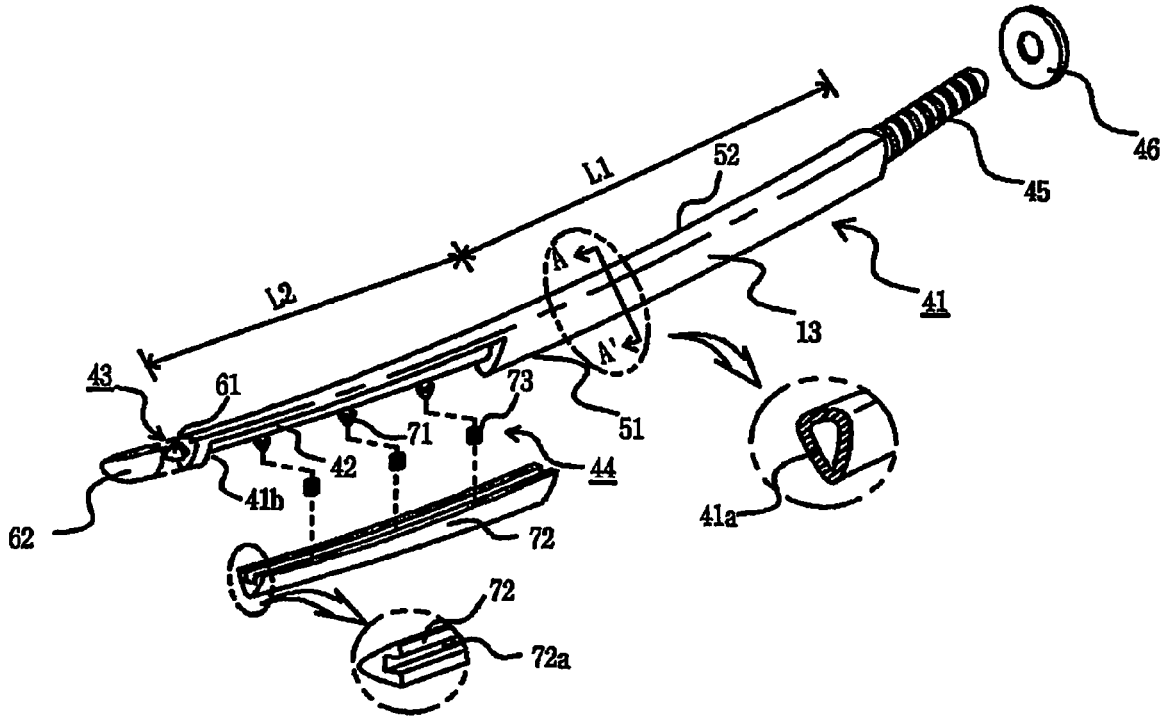
FIG. 10 is a perspective illustrating an assembly of a training sword according to a third embodiment of the present invention.
Figure 11:
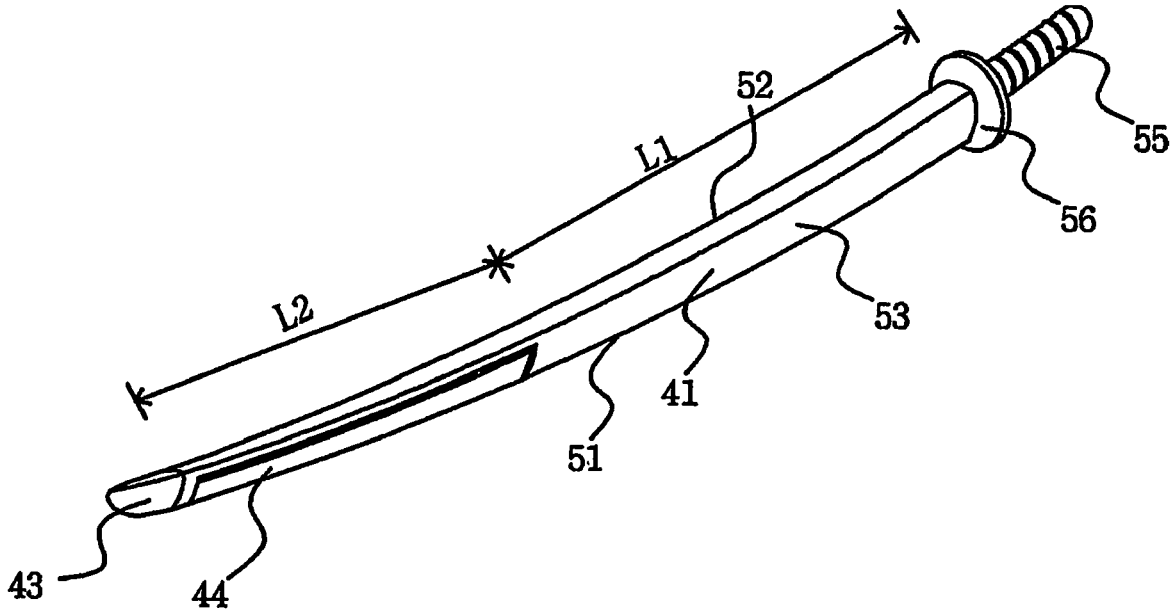
FIG. 11 is a perspective of the training sword in FIG. 10.
Figure 12:
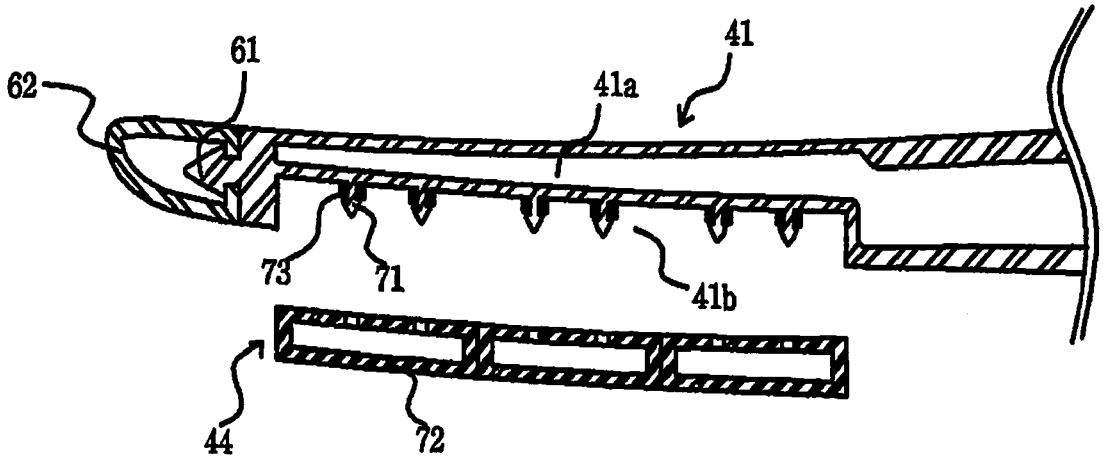
FIG. 12 is a cross-sectional view of an assembly of s sword body in FIG. 11.
Figure 13:
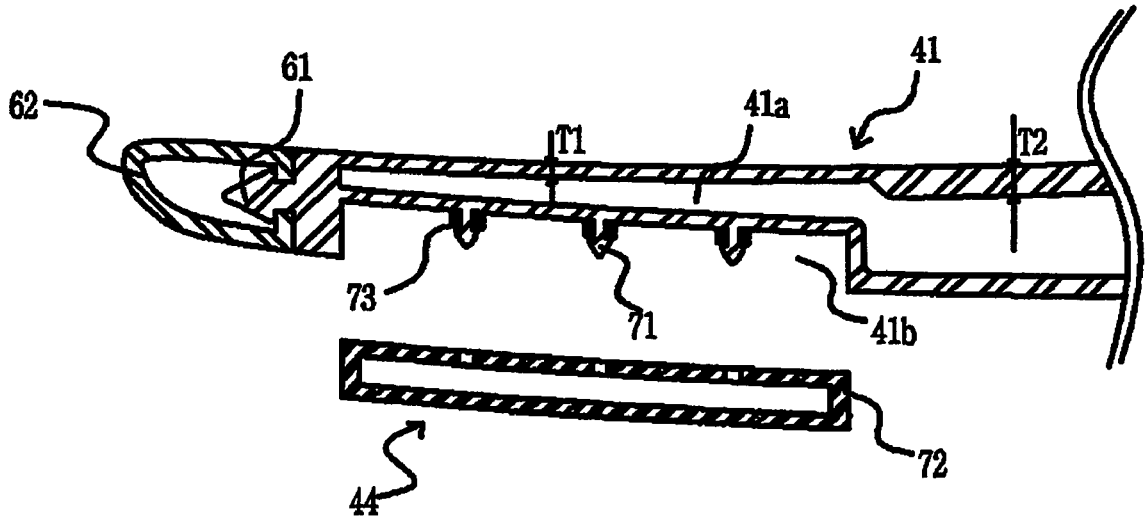
FIG. 13 is a cross-sectional view illustrating modification of the sword body according to the third embodiment of the present invention.

FIG. 9 is a cross-sectional view illustrating a modified sword which is different from one of FIG. 7. The training sword in FIG. 9 includes: a first supporting plate 31, which is in a type of disk and has a first clamping recess 31*a* protruded from one side thereof, formed at a neck of the sword body inner cover 1; a second supporting plate 32 extended from an end of the sword body outer cover 4, which has a second clamping recess 32*a* protruded from one side thereof, wherein the second clamping recess 32*a* is opposite to the first clamping recess 31*a*; a single shock-absorbing spring 33 inserted into the first clamping recess 31*a* of the first supporting plate 31 and the second clamping recess 32*a* of the second supporting plate 31; and a cylindrical cover case 34, one end of which is fixed to an outer circumference of the first supporting plate 31 and the other end of which is fixed to an outer circumference of the second supporting plate 32, covering the single shock-absorbing spring 33.

A fixing member (not shown) fixes the cylindrical cover case 34 and the sword body inner cover 1, by passing through them.

In the shock-absorbing structures against the stabbing action illustrated in FIGS. 7 to 9, the joint of the cylindrical cover cases 25 and 34 and the first supporting plates 21 and 31 can be achieved in various types.

In this embodiment, a protruded underline 27 is formed at the outer circumference of the first supporting plate 21 or 31 and an undercut recess 35 is formed at the inner circumference of the cylindrical cover case 25 or 34. Accordingly, when the cylindrical cover case 25 or 34 is inserted into the first supporting plate 21 or 31, the protruded underline 27 is fitted in the undercut recess 35.

The scabbard illustrated in the first embodiment can be available to the sword body of the second embodiment.

The detailed operation of the training sword will be described below.

First, when the trainee takes the grip 2 and exercises the basic postures and actions, such as cutting and stabbing action, in the art of swordsmanship, a swift swing can be achieved with the minimum resistance of the air because the blade part 11 of the sword body outer cover 4 is sharp. Also, since the sword body inner cover 4 has a space therein, the weight of the training sword is light and the center of the gravity is positioned at the grip taken by the trainee's hand. This makes the trainee take actions of stabbing and cutting without a load on the arm muscle and then has the trainee take a feeling of a real sword.

Also, when the trainee gives a shock to the opponent on his neck, waist, shoulder or an object in the sword fighting practice, an effective sound that is generated by the collision of the sword body inner cover 1 and the sword body outer cover 4 increases the ambience of the fighting and the shock-absorbing air layer reduces the shock from the sword body. This the shock-absorbing structure prevents an injury upon the opponent trainee or reduces a sharp pain of him.

The shock-absorbing spring 24 shrinks from their original positions. The further covering of the sword body inner cover 1, the sword body outer cover 4 is pushed toward the grip in the cylindrical cover case 25 when the trainee stabs the sword into an opponent or an object. As a result, a shock on the opponent is absorbed somewhat. When the stabbing action has been finished, the sword body outer cover 4 is restored by elasticity of the shock-absorbing springs 24.

On the other hand, when great strike or brandish actions are imposed on the opponent or an object in the sword fighting practice, the rubber band 6 also absorbs the shock which is transferred from the sword body inner cover 1 to the grip. The shock is not transferred to the trainee's wrist or arm muscle. Therefore, the wrist is protected from the striking shock and the fatigue of the arm muscle is also reduced with the improvement of the sword fighting practice.

A third embodiment of the present invention will be described in detail referring to the accompanying drawings.

First, referring to FIGS. 10 to 13, the training sword according to the third embodiment of the present invention includes: a sword body 41 having a hollow part 1*a* therein, wherein a blade part 51 is formed in a lower part thereof in the longitudinal direction, wherein a sword back part 52 is formed at the upper portion, wherein a side part 13 is formed at the side, and wherein an incised recess 41*b* is formed at the front portion thereof in the longitudinal direction by incising a portion of the side part 13; a supporting member 42 forming a recessed face in an incised recess 41*b* of the sword body 41 along the blade part 51; a first shock-absorbing member 43 formed at the front end of the sword body 41, reducing a shock on an object when a trainee takes the stabbing action against an opponent trainee; a second shock-absorbing member 44 fitted in the incised recess 41*b* of the sword body 41 with the formation of another blade, whereby the shock is absorbed when the trainee takes the stabbing action against the opponent trainee; a grip 45 for handling the sword body 41, being formed at the rear end of the sword body 41; and a cross-guard 46 is formed at the boundary between the sword body 41 and the grip 45 in order to protect the trainee's hands from another training sword of his opponent during the sword fighting practice.

In this embodiment, the sword body 41 and the grip 45 are made from injection molded synthetic resin, such as polyethylene (PE) and polyvinylchloride (PVC), which are fabricated in a body. Accordingly, the training sword according to the present invention has a shape the trainee wants to have, for example, straight or curved sword, by mass production.

The sword body 41 consists of the central part L1 and a stroke part L2 and the width thereof is getting narrower and narrower from the central part L1 to the stroke part L2 with the formation of a tapered body. As shown in the cross-sectional view illustration the central part L1 of the sword body in FIG. 10, the sword back part 52 has a round shape in a little curvature, but is at an angle with both faces of the side part 53. The blade part 51 has a sharpness at the lower part of the side part 53. Accordingly, the sword body 41 has a lozenge-shaped cross-sectional view with a sharply edged blade. In this structure, since the strength of the sword blade part 51 and the sword back part 52 is strong and the side part 53 has a shock buffering feature, the shock, which is imposed on the trainee by a bale of an opponent sword in the sword fighting practice, is dispersed by the side part 52 and the hollow 41*a*.

Further, in this embodiment, the center of gravity can be controlled by making the thickness (T1) of the central part L1 and the thickness (T2) of the stroke part L2 different in the hollow 41*a* of the sword body 41. That is, by making the thickness of the sword body thinner and thinner from the central part L1 to the stroke part L2 and by positioning the center of gravity near by the central part L1, air resistance is minimized in the swing and striking actions and trainee's wrist or arm muscle is protected from exhaustion.

While the above-mentioned embodiment illustrates the sword body 41 in which the thickness of the hollow 41*a* is different from that of the stroke part L2, it can be obtained by filling the hollow with synthetic materials, such as foaming and epoxy resins, and by hardening the filling materials. This sword may give the trainee a feeling of a real sword because the trainee feels the weight, straightness and inertia momentum which can be taken in a real sword.

The first shock-absorbing member 43 includes a joint member 61 formed at the front end of the sword body 41 and a blade ending member 62 inserted into the joint member 61. The blade ending member 62 has the same shape as the blade part, the sword back part and the side part of the sword body 41 and is made from synthetic resin or rubber. Accordingly, when the trainee takes an stabbing action against an opponent trainee using the sword body 41, the blade ending member 62 absorbs a shock imposed on the opponent trainee due to the inherent elastic features.

The second shock-absorbing member 44 includes: a joint protrusions 71 protruded from a surface, which is opposite to the supporting member 42, toward the sword blade part 51; a shock-absorbing blade member 72 having a joint recess 72*a* into which the joint protrusions 71 are inserted, wherein the incised recess 41*b* of the sword body 41 is fitted in the shock-absorbing blade member 72 and the shock-absorbing blade member 72 is in contact with a body of the trainee at the time of the cutting and stabbing actions; and springs 73 inserted into the joint protrusions 71 and proving an elastic power for the shock-absorbing blade member 72. When the trainee takes the cutting and stabbing actions toward an opponent trainee, the shock-absorbing blade member 72 may reduce a shock imposed on the opponent trainee through the springs 73 of the above-mentioned second shock-absorbing member 44.

In this embodiment, the shock-absorbing blade member 72 is made from synthetic or natural rubber. Like this, in case that the shock-absorbing blade member 72 is made from synthetic or natural rubber, this material itself first absorbs the shock imposed on an object (opponent trainee) and the springs 73 secondarily absorbs the shock so that a physical injury can be remarkably reduced in the sword fighting practice.

In the joint protrusions 71, the diameter of the head is larger than that of the stem. Accordingly, the joint protrusions 71 are inserted into and joined to the joint recess 72*a* of the shock-absorbing blade member 72. However, the present invention is not restricted to this structure set fourth above. For example, joint protrusions can be elastic hook pieces based on an axis-directional joint. The joint of the supporting member 42 and the shock-absorbing blade member 72 can be modified and this modification is well known to those skilled in the art to which the subject pertains and further description will be omitted.

As another modification in forming the shock-absorbing blade member 72, a plurality of the incised recesses (41*b*) can be formed in specific several sections of the sword body 41 and the shock-absorbing blade member 72 is simultaneously inserted into the incised recesses. When the trainee takes striking and cutting actions to an object, trainee's wrist or arm muscle is protected from exhaustion in any part of the sword blade part 51.

Likewise, the scabbard of the first embodiment can be applied to the training sword in the third embodiment.

The detailed operation of the training sword will be described below.

When the trainee takes the grip 45 and exercises the basic postures and actions in the art of swordsmanship, a swift swing can be achieved with the minimum resistance of the air because the blade part 51 of the sword body 41 is sharp. Also, since the inner portion of the sword body 41 has a hollow, the weight of the training sword is light and the center of the gravity is positioned at the grip taken by the trainee's hand. This makes the trainee take actions of stabbing and cutting without a load on the arm muscle and then has the trainee take a feeling of a real sword.

Also, in case where the trainee gives a shock to the opponent on his neck, waist, shoulder or an object in the sword fighting practice, since the shock-absorbing blade member 72 is made from a shock-absorbing rubber material, it first absorbs the shock and the springs 73 inserted into the joint protrusions 71 secondarily absorbs the shock so that a physical injury and pain can be remarkably reduced in the sword fighting practice. Likewise, when a shock is imposed on an opponent trainee by the stabbing action, a stabbing pressure is absorbed by the blade ending member 62 since the blade ending member 62, which is positioned at the end of the sword, is made from a shock-absorbing rubber material.

Also, when a strike action is imposed on the opponent or an object in the sword fighting practice, since a shock is transferred to the shock-absorbing blade member 72 and absorbed by it, the wrist is protected from the striking shock and the fatigue of the arm muscle is also reduced with the improvement of the sword fighting practice.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

The present invention is applicable to the art of swordsmanship.

The invention claimed is:

1. A training sword, comprising:

a grip formed at an end of the training sword;

a sword body member comprising a length, wherein the sword body member includes:

at least one sword body inner cover for reducing a shock generated by a striking action; and a sword body outer cover which covers the sword body inner cover, wherein a gap is provided between the sword body inner cover and the sword body outer cover; and a scabbard for protecting the sword body member, wherein a length of the scabbard is shorter than the length of the sword body member so that the sword body member passes through the scabbard.

2. The training sword in accordance with claim 1, wherein the scabbard comprises a same cross-section as the sword body outer cover and wherein the scabbard covers the sword body member near a cross-guard of the sword body member and the scabbard partly exposes an end of the sword body member.

3. The training sword in accordance with claim 2, wherein the scabbard has rings at both ends thereof and wherein the rings are tied with a string.

4. The training sword in accordance with claim 1, further comprising a cross-guard which is formed at a boundary between the sword body member and the grip.

5. The training sword in accordance with claim 1, wherein the sword body member including the sword body outer cover includes a first sword body inner cover which is spaced out from the sword body outer cover by a predetermined gap and wherein the grip and the first sword body inner cover are formed in a body.

6. The training sword in accordance with claim 5, further comprising a shock-absorbing rubber member inserted between the first sword body inner cover and the sword body outer cover for providing the predetermined gap, whereby the shock-absorbing rubber member absorbs a shock.

7. The training sword in accordance with claim 5, further comprising a shock-absorbing and restoring member formed between the grip and an end of the sword body outer cover, wherein the first sword body inner cover is formed to be shorter than the sword body outer cover by a predetermined length which is determined by a shrinking distance of the sword body outer cover.

8. The training sword in accordance with claim 7, wherein the shock-absorbing and restoring member includes:

a first supporting plate formed at a neck of the first sword body inner cover;

a second supporting plate formed at an end of the sword body outer cover, being opposite to the first supporting plate;

a plurality of fixed protrusions respectively formed at the first and second supporting plates;

a plurality of shock-absorbing springs fixed to both ends of the fixed protrusions; and a cover case, one end of which is fixed to an outer circumference of the first supporting plate and the other end of which is fixed to an outer circumference of the second supporting plate.

9. The training sword in accordance with claim 7, wherein the shock-absorbing and restoring member includes:

a first supporting plate formed at a neck of the first sword body inner cover, having a first clamping recess formed at an end thereof;

a second supporting plate formed at an end of the sword body outer cover, having a second clamping recess formed on a surface which is opposite to the first supporting plate;

a shock-absorbing spring inserted into the first clamping recess and the second clamping recess; and a cover case, one end of which is fixed to an outer circumference of the first supporting plate and the other end of which is fixed to an outer circumference of the second supporting plate.

10. The training sword in accordance with claim 5, wherein the sword body outer cover and the first sword body inner cover respectively includes:

a hollow in an inner part thereof;

a blade part formed in a lower part of the sword body member and in the longitudinal direction of the sword body member;

a sword back part formed at an upper part of the sword body member; and a side part formed at both sides of the sword body member.

11. The training sword in accordance with claim 10, wherein the first sword body inner cover has a filling material therein.

12. The training sword in accordance with claim 1, wherein the sword body inner and outer covers respectively have a cross-section of a circle.

13. The training sword in accordance with claim 1, wherein the sword body member is a multistructure member including the sword body inner cover and wherein the sword body member includes:

a first sword body inner cover which is spaced out from the sword body outer cover by a predetermined gap; and a second sword body inner cover which is spaced out from the first sword body inner cover, wherein the grip and the second sword body inner cover are formed in a body.

14. The training sword in accordance with claim 13, further comprising:

a first joint and shock-absorbing member inserted between the sword body outer cover and the first sword body inner cover inner; and a second joint and shock-absorbing member inserted between the first and second sword body inner covers.

15. The training sword in accordance with claim 14, further comprising a fixing member passing through the first sword body inner cover, the first joint and shock-absorbing member, the second sword body inner cover and the second joint and shock-absorbing member.

16. The training sword in accordance with claim 13, further comprising a shock-absorbing and restoring member formed between the grip and an end of the sword body outer cover, wherein the first sword body inner cover is shorter than the sword body outer cover in order to reduce a shock when taking a stabbing action.

17. The training sword in accordance with claim 16, wherein the shock-absorbing and restoring member includes:

a first supporting plate formed at a neck of the first sword body inner cover; a second supporting plate formed at an end of the sword body outer cover;

a plurality of fixed protrusions respectively formed at the first and second supporting plates;

a plurality of shock-absorbing springs fixed to both ends of the fixed protrusions; and a cover case, one end of which is fixed to an outer circumference of the first supporting plate and the other end of which is fixed to an outer circumference of the second supporting plate.

18. The training sword in accordance with claim 16, wherein the shock-absorbing and restoring member includes:

a first supporting plate formed at a neck of the first sword body inner cover, having a first clamping recess formed at an end thereof; a second supporting plate formed at an end of the sword body outer cover, having a second clamping recess formed on a surface which is opposite to the first supporting plate;

a shock-absorbing spring inserted into the first clamping recess and the second clamping recess; and a cover case, one end of which is fixed to an outer circumference of the first supporting plate and the other end of which is fixed to an outer circumference of the second supporting plate.

19. The training sword in accordance with claim 13, wherein the sword body outer cover and the first and second sword body inner covers respectively includes:

a hollow in an inner part thereof; a blade part formed in a lower part of the sword body member and in the longitudinal direction of the sword body member;

a sword back part formed at an upper part of the sword body member; and a side part formed at both sides of the sword body member.

20. The training sword in accordance with claim 19, wherein the second sword body inner cover has a filling material therein.

21. The training sword in accordance with claim 13, wherein the first and second sword body inner covers respectively have a cross-section of a circle.

22. A training sword comprising:

a sword body having a blade part and an incised recess, wherein the incised recess is formed by removing a predetermined position of the sword body;

a plurality of supporting means formed in the incised recess;

a first shock-absorbing means comprising a joint member formed at a front end of the sword body and a sword blade ending member inserted into the a joint member, wherein the sword blade ending member is made from a synthetic resin or rubber;

a second shock-absorbing means joined to the supporting means formed in the incised recess for reducing a shock; and a grip formed at an end of the training sword.

23. The training sword in accordance with claim 22, wherein the sword body continuously narrows from an end joined to the grip to an opposite end of the grip.

24. The training sword in accordance with claim 22, wherein the second shock-absorbing means includes:

a shock-absorbing blade member having a joint recess into which the plurality of supporting means are inserted; and springs joined to the plurality of supporting means for absorbing a shock imposed on the sword body.

25. A training sword comprising:

a sword body comprising a blade part and an incised recess, wherein the incised recess is formed by removing a predetermined position of the sword body;

a plurality of supporting means formed in the incised recess;

springs joined to the plurality of supporting means for absorbing a shock imposed on the sword body;

a shock-absorbing blade member comprising a joint recess into which the plurality of supporting means are inserted for reducing a shock; and a grip formed at an end of the training sword.

26. The training sword in accordance with claim 25, further comprising a shock-absorbing means formed at a front end of the sword body.

27. The training sword in accordance with claim 25, further comprising a scabbard which is shorter than the sword body and then exposes a front end of the sword body.

* * * * *